US009961430B2

(12) United States Patent
Chang et al.

(10) Patent No.: US 9,961,430 B2
(45) Date of Patent: May 1, 2018

(54) AUTOMATICALLY CONTROLLABLE SOUND ACCESSORY

(71) Applicant: Samsung Electronics Co., Ltd., Gyeonggi-do (KR)

(72) Inventors: Juhee Chang, Gyeonggi-do (KR); Sukgyong Kim, Gyeonggi-do (KR); Taeeon Kim, Gyeonggi-do (KR); Cheolyong Park, Gyeonggi-do (KR); Sunghoon Jeong, Gyeonggi-do (KR); Juntai Kim, Gyeonggi-do (KR); Sunyoung Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 82 days.

(21) Appl. No.: 14/596,454

(22) Filed: Jan. 14, 2015

(65) Prior Publication Data

US 2015/0201267 A1 Jul. 16, 2015

(30) Foreign Application Priority Data

Jan. 14, 2014 (KR) ..... 10-2014-0004356

(51) Int. Cl.

| | |
|---|---|
| ***H04R 1/10*** | (2006.01) |
| *H04R 3/12* | (2006.01) |
| *H04R 5/04* | (2006.01) |
| *H04R 29/00* | (2006.01) |

(52) U.S. Cl.

CPC ..... *H04R 1/1041* (2013.01); *H04R 1/1091* (2013.01); *H04R 3/12* (2013.01); *H04R 5/04* (2013.01); *H04R 29/00* (2013.01); *H04R 2430/01* (2013.01); *H04R 2460/03* (2013.01)

(58) Field of Classification Search

CPC ..... H04R 1/10; H04R 1/1008; H04R 1/1041; H04R 5/033; H04R 5/0335; H04R 2201/10; H04R 2201/103; H04R 1/1091; H04R 3/12; H04R 5/04; H04R 29/00; H04R 2430/01; H04R 2460/03

USPC ..... 381/58, 74, 123, 370, 374, 384

See application file for complete search history.

(56) References Cited

U.S. PATENT DOCUMENTS

| | | | | |
|---|---|---|---|---|
| 7,953,231 | B2 | 5/2011 | Ishida | |
| 8,335,312 | B2 * | 12/2012 | Gerhardt | H04M 1/6066 379/430 |
| 2008/0157991 | A1 * | 7/2008 | Raghunath | G11B 31/02 340/686.1 |
| 2010/0020252 | A1 | 1/2010 | Otsuki et al. | |

(Continued)

FOREIGN PATENT DOCUMENTS

| | | | |
|---|---|---|---|
| JP | 5-62290 | A | 3/1993 |
| JP | 2003-37886 | A | 2/2003 |

(Continued)

*Primary Examiner* — Jason R Kurr

(74) *Attorney, Agent, or Firm* — Cha & Reiter, LLC

(57) ABSTRACT

A headset includes a first speaker; a second speaker; a connector connecting the first speaker and the second speaker; and a switch configured to generate different electrical signals according to states in which the first speaker and the second speaker move close to and away from each other, wherein the electrical signals are used to selectively control an output of contents that is being output from the headset.

10 Claims, 7 Drawing Sheets

(56) References Cited

U.S. PATENT DOCUMENTS

| | | | | |
|---|---|---|---|---|
| 2010/0020982 | A1* | 1/2010 | Brown | H03G 3/20 381/74 |
| 2012/0099738 | A1 | 4/2012 | Lee et al. | |
| 2013/0038458 | A1* | 2/2013 | Toivola | H04M 1/05 340/665 |
| 2013/0129106 | A1 | 5/2013 | Sapiejewski | |
| 2013/0129110 | A1* | 5/2013 | Harper | H04R 1/1041 381/74 |
| 2013/0345842 | A1* | 12/2013 | Karakaya | H04R 5/04 700/94 |

FOREIGN PATENT DOCUMENTS

| | | | |
|---|---|---|---|
| JP | 2009-27568 | A | 2/2009 |
| KR | 10-2007-0066385 | A | 6/2007 |
| KR | 10-2008-0023479 | A | 3/2008 |

* cited by examiner

AUTOMATICALLY CONTROLLABLE SOUND ACCESSORY

CROSS-REFERENCE TO RELATED APPLICATION

This application claims priority from and the benefit under 35 U.S.C. § 119(a) of Korean Patent Application No. 10-2014-0004356, filed on Jan. 14, 2014, which is hereby incorporated by reference for all purposes as if fully set forth herein.

BACKGROUND

1. Field of the Disclosure

Various embodiments of the present disclosure relate to an automatically controllable sound accessory, and more particularly, to a sound accessory which can perform a specific function even when the sound accessory is merely put on or taken off using a switch.

2. Description of the Prior Art

Today, portable terminals such as smartphones are providing users with various functions including a music output function. An interest in acoustic devices enhancing the users's experience in listening to music has increased.

Among acoustic devices for listening of music, headsets may be typically classified into an active headset and a passive headset. The active headset provides means to cancel noise using a circuit before reaching one's ear, and the passive headset blocks out sound with material such as rubber and styrofoam. As such, the active headset may employ a separate sensor, and the passive headset does not.

When an interruption occurs when a user is enjoying the music via a headphone, two actions are typically necessary during this mode. That is, a user must actively take off the headset and also activate a stop button to pause the music. However, in some instances, unintended situations (e.g., someone tries to make conversation or asks for help) may occur as the user hurries to take these actions.

To address above drawbacks, a technique of recognizing the pressure within the headset using a pressure sensor and then automatically changing the audio settings of the headset have been proposed. However, this technique requires a separate sensor and only applicable to an active headset.

That is, because a separate sensor cannot be mounted on a passive headset, the users can only manually change the audio settings only by removing the headset. Accordingly, the passive headset may negatively impact user's convenience. Meanwhile, the active headset also increase costs and requires complex circuits when a sensor implemented for automatically detecting an operation thereof is mounted.

Accordingly, there is a need for an improved headset to address the above drawbacks.

SUMMARY

Various embodiment of the present disclosure can enable a user to easily change the audio settings through an act of simply putting on or taking off a headset by employing a switch in the headset. Accordingly, an acoustic device that increases user convenience by outputting contents can be provided. Further, various embodiments of the present disclosure can be applied to both an active headset and a passive headset irrespective of the type of the headset.

In accordance with an aspect of the present disclosure, there is provided a headset including: a first speaker; a second speaker; a connector connecting the first speaker and the second speaker; and a switch configured to generate different electrical signals according to states in which the first speaker and the second speaker move close to and away from each other, wherein the electrical signals are used to selectively control an output of contents that is being output from the headset.

Various embodiments of the present disclosure can improve convenience by allowing the user to perform a specific function through an act of simply putting on or taking off a passive headset and reduce manufacturing costs of the headsets by eliminating the need to use expensive active elements.

BRIEF DESCRIPTION OF THE DRAWINGS

The above features and advantages of the present disclosure will be more apparent from the following detailed description in conjunction with the accompanying drawings, in which.

DETAILED DESCRIPTION

Figure 1:
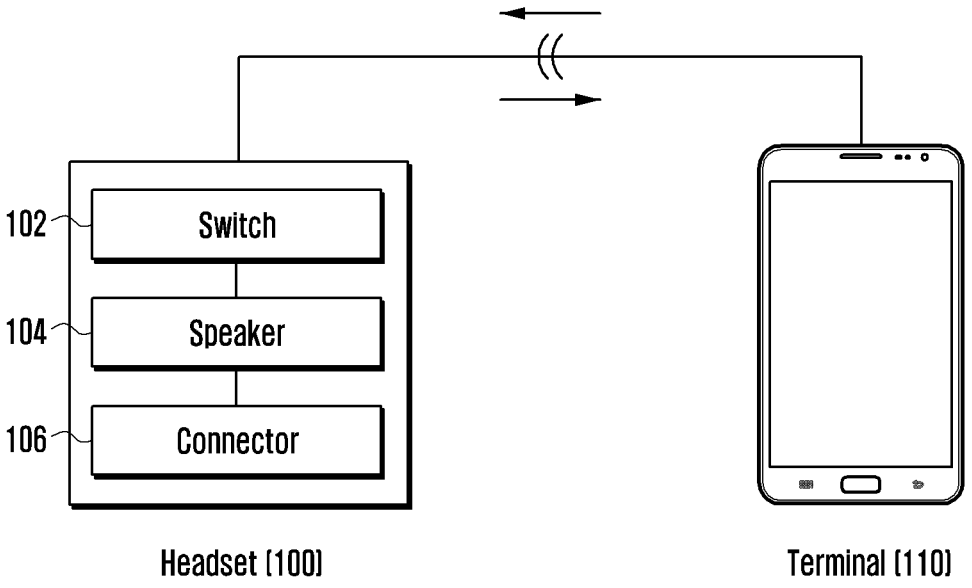
FIG. 1 is a block diagram of a headset according to any one of various embodiments of the present disclosure.

Hereinafter, various embodiments of the present disclosure will be described in detail with reference to the accompanying drawings. It should be noted that the same elements will be designated by the same reference numerals although they are shown in different drawings. For the purposes of clarity and simplicity, a detailed description of known functions and configurations incorporated herein will be omitted as it may make the gist of various embodiments disclosed herein rather unclear. Thus, it should be noted that only parts necessary for understanding operations according to various embodiments disclosed herein will be described, and the description of other parts will be omitted in order to prevent obscuring of the gist of various embodiments disclosed herein.

An electronic device 100 according to the present disclosure may be, for example, a combination of one or more of a smartphone, a tablet personal computer, a mobile phone, a video phone, an e-book reader, a desktop personal computer, a laptop personal computer, a netbook computer, a Personal Digital Assistant (PDA), a Portable Multimedia Player (PMP), an MP3 player, a mobile medical device, an electronic bracelet, an electronic necklace, an electronic accessory, a camera, a wearable device, an electronic clock, a wrist watch, a home appliance (e.g. a refrigerator, an air conditioner, a cleaner, an oven, a microwave oven, a washing machine, a vacuum cleaner, etc.), an artificial intelligent robot, a Television (TV), a Digital Video Disk (DVD) player, an audio player, various medical machines (e.g. a Magnetic Resonance Angiography (MRA), a Magnetic Resonance Imaging (MRI), a Computed Tomography (CT), a tomography camera, a sonography device, etc.), a navigation device, a Global Positioning System (GPS) receiver, an Event Data Recorder (EDR), a Flight Data Recorder (FDR), a set-top box, a TV box (e.g. SamSung HomeSync™, Apple TV™, or Google TV™), an electronic dictionary, a vehicle infotainment device, electronic equipment for a ship (e.g. navigation equipment for a ship, a gyrocompass, etc.), avionic equipment, a security device, an electronic cloth, an electronic key, a camcorder, a game console, a Head-Mounted Display (HMD), a flat panel display device, an electronic frame, an electronic album, a furniture or a part of a building/structure including a communication function, an electronic board, an electronic signature receiving device, a projector, etc. However, it is obvious to those skilled in the art that the electronic device according to the present disclosure is not limited to the aforementioned devices.

FIG. 1 is a block diagram of a headset according to any one of various embodiments of the present disclosure.

The headset 100 may include a switch 102, a speaker 104, and a connector 106.

The switch 102 may generate different electrical signals according to states in which the first speaker and the second speaker move close to and away from each other using a passive element. For instance, when a user is wearing the headset 100, the first speaker and the second speaker remain spaced apart from each other. Also, if the user takes off the headset 100, the first speaker and the second speaker get close to each other, and such a state may generate different electrical signals and may be detected by the terminal 110 (or external device) for performing a specific function. The switch 102 of the headset 100 according to any one of various embodiments of the present disclosure may use a reed switch and a magnetic material. A reed switch is a switch that uses a phenomenon in which a reed is magnetized when a magnetic material approaches or nears the reed switch. Thus, the switch 102 including a reed switch and a magnetic material may be located in the speaker 104 of the headset 100 to generate different electrical signals as the first speaker and the second speaker get close to (short-circuited) or back away from (opened) each other.

The switch 102 of the headset 100 according to another embodiment of the present disclosure may include a dome switch. The dome switch may include an upper part and a lower part. The switch 102 that uses a dome switch may be located in the connector 106 of the headset 100 to generate different electrical signals as the first speaker and the second speaker get close to (short-circuited) or back away from (opened) each other.

The speaker 104 may output a content signal received from the terminal 110. The speaker 104 may include at least one speaker. The headset 100 according to another embodiment of the present disclosure may include two speakers, and the two speakers may be defined as a first speaker and a second speaker. Here, the speaker 104 of the headset 100 may also include a switch 102 that uses a reed switch and a magnetic material.

The connector 106 may connect the first speaker and the second speaker. The connector 106 may be formed of a resilient material such that a user can conveniently put on or take off the headset 100, and may be separately covered by rubber or sponge to provide a comfortable wearing feeling.

Further, the connector 106 of the headset 100 according to any one of various embodiments of the present disclosure may include a switch 102 that uses a dome switch.

FIG. 2 is a diagram for explaining an operational principle of a reed switch of the headset 100 according to any one of various embodiments of the present disclosure.

A reed switch is a switch that uses a phenomenon in which a reed is magnetized when a magnetic material approaches the reed switch. Reference numeral 210 of FIG. 2A denotes an off state of the reed switch. At this state, the reeds 212 do not contact each other because they are not magnetized by a magnetic material approaches them. Reference numeral 220 of FIG. 2A denotes an on state of the reed switch.

Figure 2A:
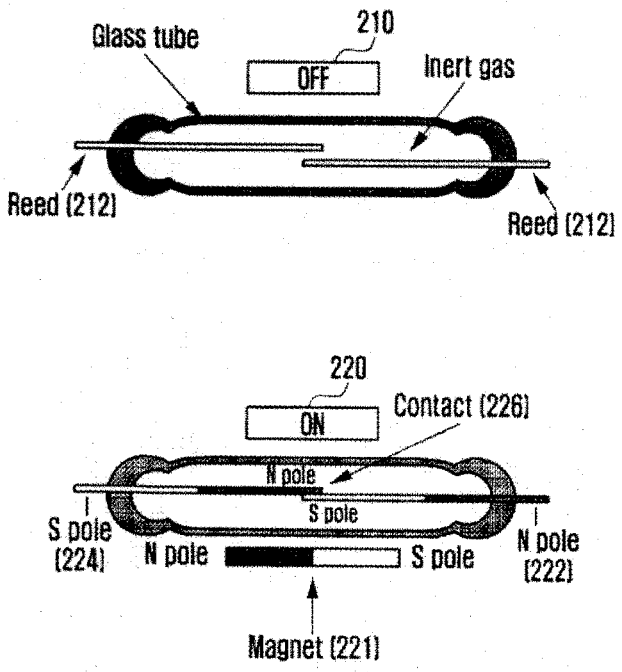
FIG. 2A and FIG. 2B are diagrams explaining an operational principle of a reed switch of a headset according to any one of various embodiments of the present disclosure.

FIG. 2A illustrates that the reeds 222 and 224 are magnetized as a magnetic material 221 gets close to the reeds 222 and 224. The left side of the left reed 224 close to the N pole of the magnetic material 221 may be magnetized to the S pole, and accordingly the right side of the left reed 224 may be magnetized to the N pole. The right side of the right reed 222 close to the S pole of the magnetic material 221 may be magnetized to the N pole, and accordingly the left side of the right reed 222 may be magnetized to the S pole. Then, the right side of the left reed 224 corresponds to the N pole, and the left side of the right reed 222 corresponds to the S pole, and as a result, the left reed 224 and the right reed 222 may contact each other as indicated by reference numeral 226. Here, the opened reed switch may be short-circuited through the contact of the reeds to generate electrical signals.

Figure 2B:
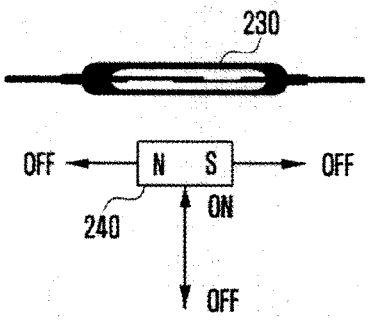

FIG. 2B illustrates an operation of a reed switch 230 in order to better understand the mechanics of components according to an approach direction of a magnetic material 240. Because the magnetization degree becomes higher as the magnetic material 240 approaches the reed switch 230, the switch may be activated. In contrast, because magnetization degree becomes lower as the magnetic material 240 moves away from the reed switch 230, the switch may not be activated. In the same way, when the magnetic material deviates from the center of the reed switch leftwards and rightwards, the two reeds are not uniformly magnetized and thus it may be difficult to properly activate the switch.

Figure 3:
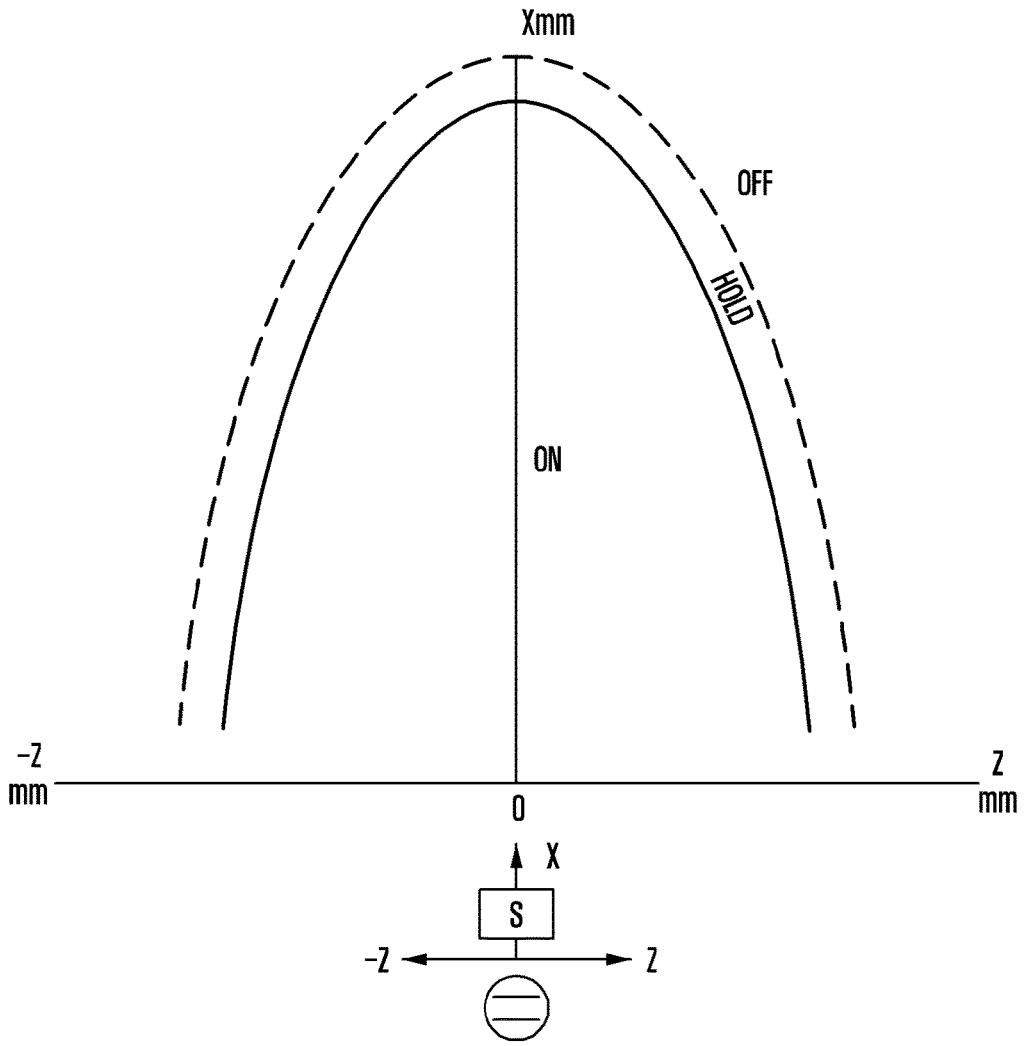
FIG. 3 is a diagram explaining an operation of a reed switch of a headset according to any one of various embodiments of the present disclosure.

FIG. 3 is a diagram explaining an operation of a reed switch of a headset according to any one of various embodiments of the present disclosure.

FIG. 3 illustrates an example in which an operation of the switch varies according to a distance between the reed switch and the magnetic material. X of the vertical axis may refer to a linear distance between the reed switch and the magnetic material and Z of the horizontal axis may refer to a leftward/rightward distance between the reed switch and the magnetic material. As shown, as the linear distance of X increases, a short-circuited state of the switch may change to an opened state of the switch, and as the horizontal distance of Z increases, a short-circuited state of the switch may change to an opened state.

Figure 4:
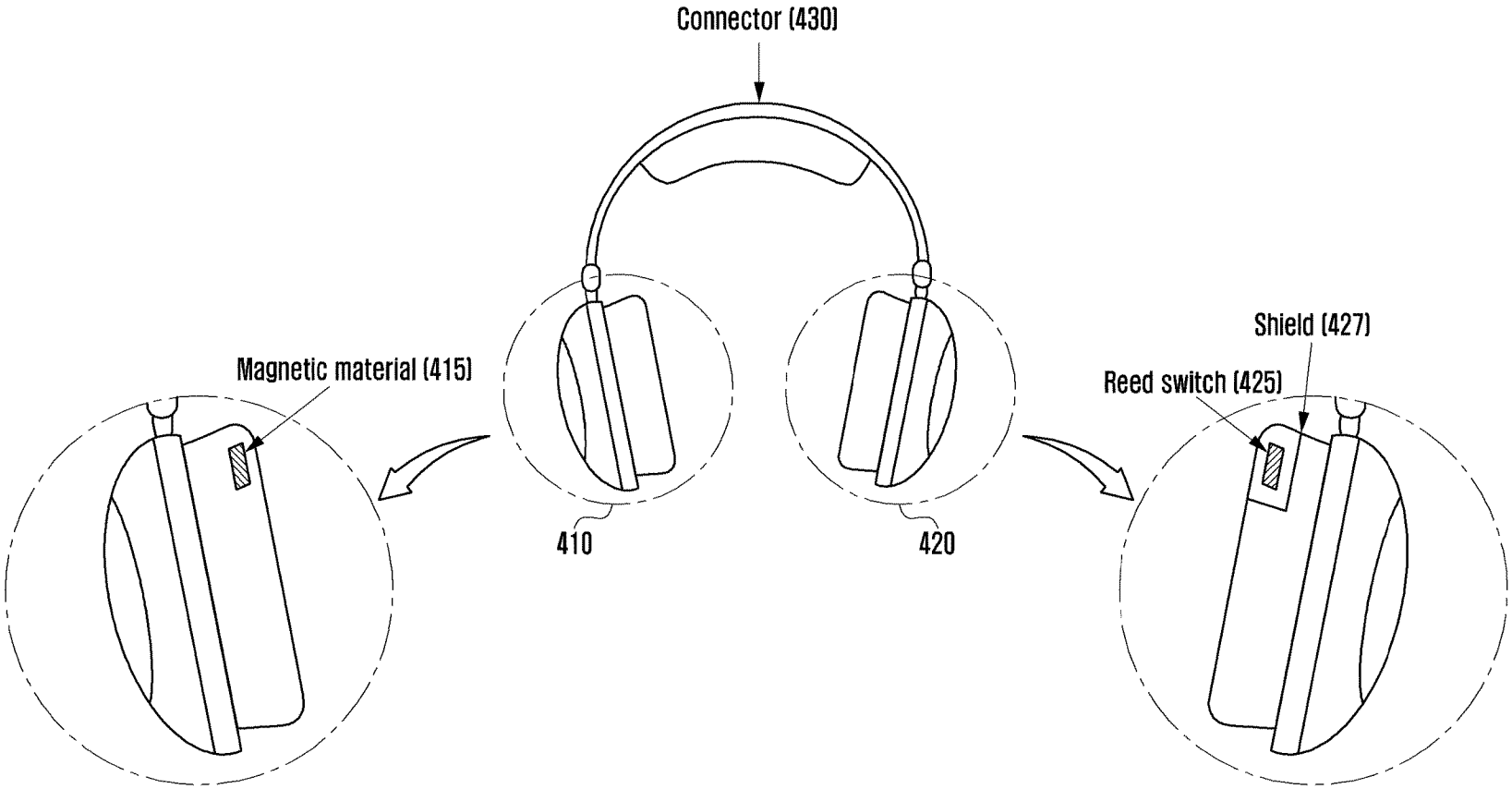
FIG. 4 is a diagram explaining an example of mounting a reed switch and a magnetic material on a headset according to any one of various embodiments of the present disclosure.

FIG. 4 is a diagram explaining an example of mounting a reed switch and a magnetic material on a headset according to any one of various embodiments of the present disclosure.

As shown, the headset 100 may include a first speaker 410, a second speaker 420, and a connector 430. The first speaker 410 the first speaker 410 generally includes a magnetic material (e.g. magnet) to produce sound. The first speaker 410 may further include other magnetic material 415. The second speaker 420 may include a reed switch 425. Like the first speaker, the second speaker also may include a magnetic material (e.x., magnet). Therefore, the magnetic material of the second speaker may act as a magnetic material for operating the reed switch 425. Accordingly, a separate shield 427 may be used to separate a mounting portion of the reed switch 425 from a magnetic material of the second speaker. For example, the shield 427 may include shield tape or device for separating the reed switch. Meanwhile, the connector 430 may connect the first speaker 410 and the second speaker 420.

The headset 100 may generate electrical signals such that the electrical signals may be used to selectively control an output of contents that are being output from the headset 100. When the first speaker 410 and the second speaker 420 of the headset 100 get close to each other, an operational principle of the reed switch described with reference to FIGS. 1 and 2 is applied such that the switch is in a short-circuited state, and accordingly an electrical signal may be generated. For example, when the user takes off the headset 100 after wearing the headset 100 on the head of the user, the first speaker and the second speaker that were spaced apart from each other get closer to each other to a degree in which they nearly come into contact each other. In this case, the reed switch is short-circuited to generate an electrical signal.

The headset 100 may transmit the generated electrical signal to a terminal connected to one end of the headset 100, and allows the terminal to perform a preset specific function. Because the state of the switch is changed into an opened or short-circuited state according to the act of putting on or taking off the headset 100, the headset 100 may transmit two different electrical signals to the terminal. Hence, the headset 100 transmits two different electrical signals to the terminal to allow the terminal to perform preset two functions.

Figure 5:
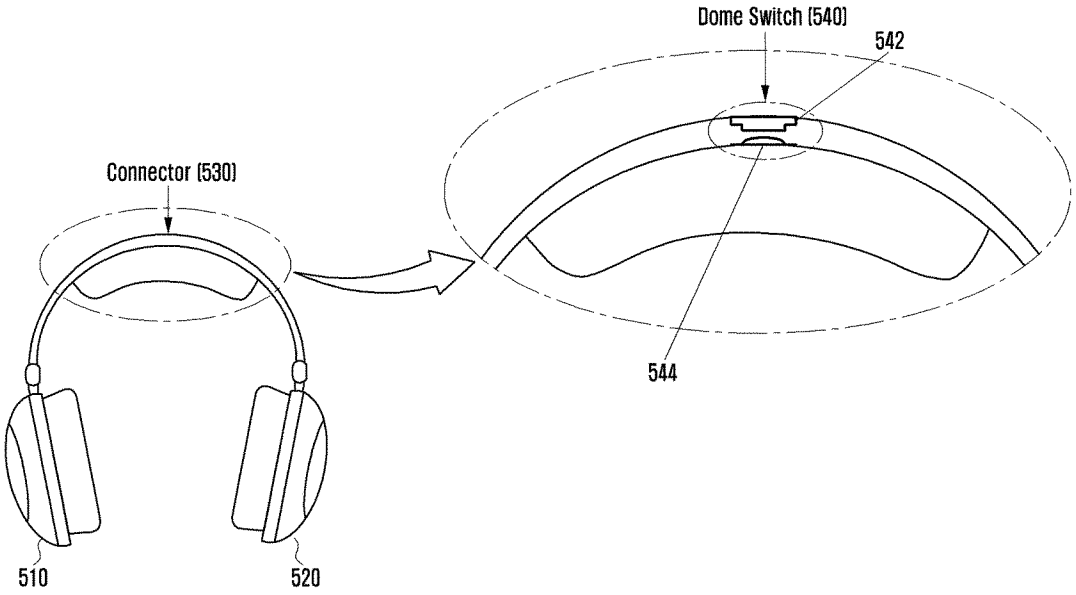
FIG. 5 is a diagram explaining a dome switch of a headset according to another one of various embodiments of the present disclosure.

For example, when the user takes off the headset 100, the reed switch is short-circuited as the reed switch and the magnetic material get close to each other. In this case, the terminal connected to the headset may detect that a level of a voltage of an internal circuit is low and may stop outputting the contents. Meanwhile, when the user puts on the headset 100, the reed switch is opened as the reed switch and the magnetic material move away from each other. In this case, the terminal connected to the headset may detect that a level of a voltage of an internal circuit is high and may output the contents. Here, a high or low level of a voltage may indicate a relative difference between voltages of an internal circuit based on whether a switch is opened or closed. For example, a voltage between 0.1~0.2V may be detected when the switch is closed, and a voltage between 0.2~0.4V may be detected when the switch is opened. The voltage range may be set or changed according to a manufacturer. FIG. 5 is a diagram explaining a dome switch of a headset according to another one of various embodiments of the present disclosure.

The headset 100 may include a first speaker 510, a second speaker 520, and a connector 530. The connector 530 may include a dome switch 540. The dome switch 540 may include an upper part 542 and a lower part 544. The upper part 542 may be fixed to a ceiling of the connector 530, and the lower part 544 may be fixed a position below the upper part 542. In particular, when the headset 100 is taken off, the lower part 544 of the headset 100 may contact the upper part of the headset 100 by bending of the connector which has been spread out. For example, as the first speaker 510 and the second speaker 520 move closer to each other, a bending degree of the connector 530 becomes higher, and then the lower part 544 pops up to contact the upper part. If the contact occurs, the dome switch 540 in an opened state is changed into a short-circuited state, and accordingly, may generate an electrical signal.

The headset 100 may transmit the generated electrical signal to a terminal connected to one end of the headset 100, and allows the terminal to perform a preset specific function. Further, because the state of the switch is changed into an opened or short-circuited state according to the act of putting on or taking off the headset 100, the headset 100 may transmit two different electrical signals to the terminal. The headset 100 transmits two different electrical signals which in turn causes the terminal to perform two preset functions.

For example, when the user takes off the headset 100, the upper part 542 and the lower part 544 of the dome switch 540 contact each other to short-circuit the dome switch. In this case, the headset 100 may transmit a low voltage level signal to the terminal, and instructs the terminal to stop outputting contents. Reversely, when the user puts on the headset 100, the upper part 542 and the lower part 544 of the dome switch 540 do not contact each other and thus the dome switch is opened. In this case, the headset 100 may transmit a high voltage level signal to the terminal, and may instruct the terminal to output contents.

Figure 6:
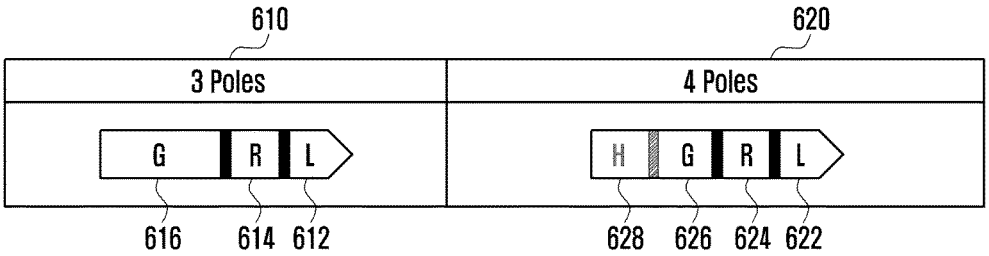
FIG. 6 is a diagram explaining an external terminal/device utilizing a method for recognizing an operation of a headset according to any one of various embodiments of the present disclosure.

FIG. 6 is a diagram explaining a terminal utilizing a method for recognizing an operation of a headset according to any one of various embodiments of the present disclosure.

Basically, a four-pole terminal 620 may be used for recognizing an operation of the headset 100. A left pole L, a right pole R, a ground G, and a mic M are sequentially arranged in a conventional four-pole terminal. In order to realize an operation recognizable by the headset 100, the mic (M) terminal may be utilized as an operation recognizable terminal H 628 and is indicated by 620 of FIG. 6. Accordingly, in the new four-pole terminal for the headset 100, a left pole L 622, a right pole R 624, a ground G 626, and a headset H 628 may be sequentially arranged.

Meanwhile, the three-pole terminal 610 also may used as indicated by reference numeral 610 of FIG. 6. A left pole L 612, a right pole R 614, and a ground G 616, are sequentially arranged in a conventional three-pole terminal. In order to realize an operation recognizable headset 100, a part of the ground G 616 terminal may be utilized as an operation recognizable terminal H 628 and is indicated by 620 of FIG. 6. Accordingly, in the new four-pole terminal for the headset 100, a left pole L 622, a right pole R 624, a ground G 626, and a headset H 628 may be sequentially arranged.

Figure 7:
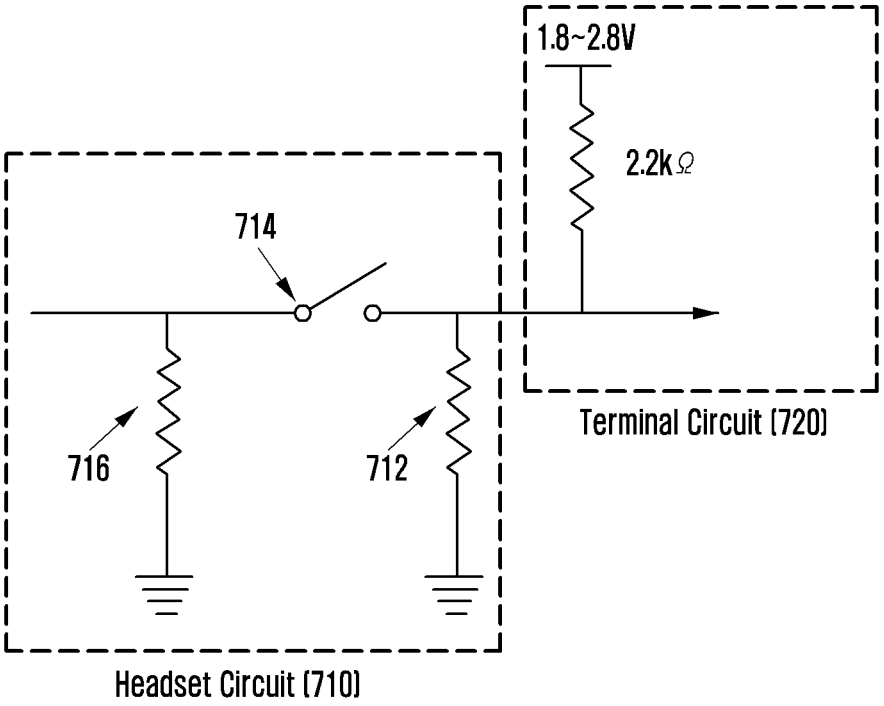
FIG. 7 is a switch circuit diagram according to any one of various embodiments of the present disclosure.

FIG. 7 is a switch circuit diagram according to any one of various embodiments of the present disclosure.

The circuit of FIG. 7 includes an internal circuit 710 of the headset 100 and an internal circuit 720 of the terminal. Both the reed switch based headset 100 and the dome switch based headset 100 according to the present disclosure may be operated based on the circuit of FIG. 7. The internal circuit 710 of the headset 100 may include a headset recognition resistor 712, a headset switch 714, and a headset operation recognition resistor 716. The internal circuit of the terminal 720 may include an input power source and an internal resistor of the terminal 720. The headset recognition resistor 712 may have a high resistance value as compared with those of the headset operation recognition resistor 716 and the internal resistor of the terminal, and the headset operation recognition resistor 716 may have a resistance value that is equal to or smaller than that of the internal resistor of the terminal.

The headset switch 714 of FIG. 7 may correspond to the reed switch or the dome switch according to the present disclosure. The headset recognition resistor 712 may normally be used to recognize a state in which the headset 100 is connected to the terminal. While the headset switch 714 is opened, the headset recognition resistor 712 may be recognized as a headset operation recognition terminal H mentioned with reference to FIG. 5.

Meanwhile, the headset switch 714 may be short-circuited or opened according to an act of taking off or putting on the headset 100. For example, when the user takes off the headset 100, the state of the reed switch or dome switch according to the present disclosure may change into a short-circuited state based on the operational principle of the reed switch. If the headset switch 714 of FIG. 7 is in a short-circuited state, the headset recognition resistor 712 and the headset operation recognition resistor 716 are connected in parallel to each other such that a voltage value transmitted to the internal circuit of the headset 100 may be lowered below a voltage value in the opened state. In this case, the headset 100 may transmit a low level signal to the terminal which in turn causes the terminal to stop outputting contents.

For example, when the user puts on the headset 100, the state of the reed switch or dome switch according to the present disclosure may change into an opened state based on the operational principle of the switch. If the headset switch 714 of FIG. 7 is in an opened state, only the headset recognition resistor 712 is operated such that a voltage value transmitted to the internal circuit of the headset 100 may become higher than a voltage value in a short-circuited state. In this case, the headset 100 may transmit a high level signal to the terminal which in turn causes the terminal to output contents again. Meanwhile, the functions that are operable by two level signals are not limited to output and stop functions. The manufacturer or user may selectively set, modify, or change the headset 100 such that two desired functions are selected from among various functions such as play, stop, fast forward, and rewind through direct setting of the terminal connected to the headset 100.

As is apparent from the foregoing, the present disclosure has an advantage in that the headset system can check the state of speakers of a passive headset without using an expensive senor to selectively control the music setting or other function settings of a terminal.

The embodiments disclosed in the specification and drawings are merely presented to easily describe technical contents of various embodiments of the present disclosure and help the understanding of them and are not intended to limit the scope of various embodiments of the present disclosure. Therefore, all changes or modifications derived from the technical idea of various embodiments of the present disclosure as well as various embodiments disclosed herein should be construed to fall within the scope of various embodiments of the present disclosure.

What is claimed is:

1. A headset comprising:

a first speaker;

a second speaker; and a connector that is at least partially rigid and including a hollow, enclosing a switch and coupling the first speaker and the second speaker, wherein the switch includes an upper member and a lower member disposed in the hollow and is configured to generate different electrical signals according to different states, the states including:

bending of the connector such that the first speaker and the second speaker move towards one other, causing contact between the upper member and the lower member within the hollow, and straightening of the connector such that the first speaker and the second speaker move away from one other, causing separation between the upper member and the lower member within the hollow, and wherein the electrical signals are used to selectively control an output signal from the headset.

2. The headset of claim 1, wherein the switch comprises a passive element.

3. The headset of claim 2, wherein the passive element comprises a dome switch.

4. The headset of claim 3, wherein the dome switch is short-circuited when the first speaker and the second speaker move close to each other and is opened when the first speaker and the second speaker move away from each other.

5. The headset of claim 4, wherein one end of the switch is coupled to an external device and other end of the switch is coupled to the headset, and the electrical signals are transmitted to the external device through the other end of the switch.

6. The headset of claim 5, wherein when being short-circuited, the dome switch generates a low level signal and transmits the low level signal to the external device.

7. The headset of claim 5, wherein when being opened, the dome switch generates a high level signal and transmits the high level signal to the external device.

8. The headset of claim 5, wherein the electrical signals are transmitted to the external device to execute preset functions of the external device.

9. The headset of claim 8, wherein the preset functions comprise two functions selected from among a play, stop, fast forward, and rewind function.

10. The headset of claim 1, wherein the electrical signals are classified into a low level signal and a high level signal.

* * * * *